United States Patent [19]

Kowalczyk

[11] 4,084,787

[45] Apr. 18, 1978

[54] CARPET INSTALLATION TOOL

[76] Inventor: Adam V. Kowalczyk, 98 Mill Creek Rd., Holland, Pa. 18966

[21] Appl. No.: 695,362

[22] Filed: Jun. 14, 1976

[51] Int. Cl.[2] ..... A47G 27/04

[52] U.S. Cl. ..... 254/57

[58] Field of Search ..... 254/57–63, 254/67

[56] References Cited

U.S. PATENT DOCUMENTS

| | | | |
|---|---|---|---|
| 520,736 | 5/1894 | Hover | 254/57 |
| 591,826 | 10/1897 | Drake | 254/61 |
| 1,160,647 | 11/1915 | Owens | 254/61 |
| 3,001,762 | 9/1961 | Skolnich | 254/62 |
| 3,105,675 | 10/1963 | Blackburn | 254/67 |
| 3,662,994 | 5/1972 | Johns | 254/93 R |
| 3,963,216 | 6/1976 | Victor | 254/62 |
| 4,008,879 | 2/1977 | Youngman | 254/57 |

*Primary Examiner*—Robert C. Watson

*Attorney, Agent, or Firm*—Weiser, Stapler & Spivak

[57] ABSTRACT

A carpet installation tool comprises a portable body which is forwardly equipped with a spring tensioned anchoring blade to engage behind a tackless carpet strip. The body downwardly carries a carpet gripper head which includes a plurality of pins suitable for engaging the carpet and stretching the carpet upon use of the tool. A motor is carried within the frame to function either a gear train or a hydraulic cylinder to move the carpet gripper head relative to the anchoring blade under motor power for carpet stretching purposes. The tool also includes a wall contacting pole and a socket to receive one end of the pole whereby the carpet gripper head can be moved by motor power relative to the pole for carpet stretching purposes.

17 Claims, 6 Drawing Figures

10
10'
12
18
20
22
24
26
28
30
54
59
68
70
72
74
76
78
80
82
84
86
88
90
94
96
98
100
102
104
106
108
110
112
113
114
116
118
120
122
6

10
12
14
16
18
20
22
24
26
28
30
32
34
36
38
40
42
44
46
48
50
52
54
56
58
60
62
64
66
68
70
72
74
76
78
80
82
84
86
88
90
94
96
122
4
4

CARPET INSTALLATION TOOL

BACKGROUND OF THE INVENTION

The present invention relates generally to carpet installation tools, and more particularly is directed to a power operated carpet stretcher.

In the installation of conventional wall to wall carpeting, it is the usual practice to anchor tackless carpet strips about the periphery of the room and then to affix the carpet in place over the floor by anchoring the peripheral edges of the carpet to the tackless strips. In order to produce a satisfactory installation of the carpet without ripples, creases, looseness or other defects in installation, it is the usual practice to employ suitable tools to stretch the carpet sufficiently prior to permanently engaging the peripheral edges of the carpet to the tackless strips.

The tools presently employed for carpet stretching purposes are all manually operated and generally comprise three distinct types of tools, namely, a knee kicker, a pole stretcher type or an anchor blade type of device.

The knee kicker is a relatively small tool which comprises generally a carpet gripper head and a padded body suitable for receiving impacts from the knee of the installer to push the carpet gripper head forwardly to thereby stretch the carpet. Such devices are relatively easy to operate by a single workman, but are limited in operation and in function by their inability to develop suitable power to stretch the carpet, especially where large rooms are involved.

The anchor blade type of installation tool comprises essentially a carpet gripper head and an anchor blade for positioning behind the tackless strip. Usually an elongated operating handle is employed to function through a leverage principle to pull the carpet gripper head toward the anchoring blade to thereby stretch the carpet in the path of travel. Such devices develop sufficient power to adequately pull and stretch the carpet but require considerable strength and the use of both hands of the operator.

The pole stretcher type of installation tool comprises a carpet gripper head and an elongated pole which extends from one sidewall of the room to enable the tool to push against the sidewall as the carpet is stretched toward the opposite sidewall. Usually a manual handle functions a lever mechanism to push the carpet gripper head towards the tackless strip for carpet stretching purposes. This tool also required considerable strength and the use of both hands of the operator. Further, regulation of the length of stretch is fixed by the design of the lever mechanism and this cannot be adjusted by the operator.

SUMMARY OF THE INVENTION

The present invention relates generally to carpet installation tools and more particularly is directed to a power operated tool to move a carpet stretching head by utilizing electrical power input. The carpet installation tool of the present invention comprises a compact, portable body that features three contact points on the floor for better control and balance by the operator. The body includes an anchoring blade that is spring tensioned to remain behind the tackless strip. If desired, the anchoring blade can be easily removed from its association with the body if the anchoring blade mode of operation is not desirable or feasible. The body incorporates a leg which contacts the floor for balance purposes and a carpet gripper head which is movable relative to the body for carpet stretching purposes. In one mode of operation, the body carries an electric motor and a suitable gear train connected to the motor to function the carpet gripper head either forwardly or rearwardly relative to the body for carpet stretching purposes. It is also contemplated that in lieu of the motor and gear train arrangement, power could be supplied to move the carpet gripper head forwardly or rearwardly relative to the body by employing a hydraulic system including a pump, cylinder and piston in a known manner.

The body includes a rearwardly facing socket into which a conventional wall to wall pole can insert to thereby utilize a wall or other stationary construction as an immovable base on which the tool can press while power urging the carpet gripper head forwardly in the carpet stretching operation. The motor or hydraulic pump can be readily controlled by a switch mounted on the body. Preferably, the switch includes a forward contact, a stop position and a rearward contact to thereby easily function the tool to move the carpet gripper head forwardly or rearwardly relative to the body during the carpet installation process.

The carpet installation tool of the present invention is a dual functioning tool which can be either a pole stretcher type to push the carpet gripper head forwardly from the wall contacting pole or, in a separate mode of operation, can function as an anchor blade type of tool by positioning the anchor blade behind the tackless strip and then functioning the motor or pump to pull the carpet gripper head forwardly in the carpet stretching operation.

The carpet installation tool of the present invention can take the place of all prior art types of carpet installation tools, namely, the knee kicker type, the anchoring blade type and the wall to wall pole stretcher type in a single tool. The tool can be operated with only one hand of the operator whereby once the tool is properly positioned, the carpet gripper head can be urged either forwardly, rearwardly or can be stopped entirely simply by the operator controlling the switch by the use of a single finger. Thus, the former two handed operation as previously required can now be completed with but one hand.

By utilizing the mechanical advantages of an electric motor and a gear train or a hydraulic pump functioning a hydraulic system, infinite stroke adjustment control is now for the first time available to the carpet installation technician. Previously, when utilizing the prior art types of anchoring blade tools and wall to wall pole stretchers with the operating handle and leverage means hereinbefore set forth, the workman could not stop the stroke of the tool at any position if desired, but rather had to fully complete the stroke by fully pressing down on the operating lever with both hands.

It is therefore an object of the present invention to provide an improved carpet installation tool of the type set forth.

It is another object of the present invention to provide a novel carpet installation tool having three contact points on the floor for better control and balance, namely, an anchoring blade, a carpet gripper head and a balance leg.

It is another object of the present invention to provide a novel carpet installation tool that includes a carpet gripper head and power operating means to move the carpet gripper head for carpet stretching purposes.

It is another object of the present invention to provide a novel carpet installation tool that includes a body, a motor secured to the body, a gear train functioned by the motor and a carpet gripper head that is movable relative to the body upon operation of the gear train for carpet stretching.

It is another object of the present invention to provide a novel portable carpet stretching tool comprising a body, a hydraulic system carried by the body, a carpet gripper head movable relative to the body upon function of the hydraulic system either forwardly or rearwardly for carpet installation purposes.

It is another object of the present invention to provide a novel, portable, electrically operated carpet stretcher including a body, an anchoring blade pivotally connected to the body and spring tensioned to remain behind a tackless strip and a carpet gripper head movable relative to the anchoring blade by electric power means.

It is another object of the present invention to provide a novel carpet installation tool comprising a body, a wall contacting pole connected to the body, a carpet gripper head movable relative to the body and the pole, and power means to move the carpet gripper head for carpet stretching purposes upon the application of electrical power.

It is another object of the present invention to provide a novel carpet installation tool that is rugged in construction, inexpensive in manufacture and trouble free when in use.

Other objects and a fuller understanding of the invention will be had by referring to the following description and claims of a preferred embodiment thereof, taken in conjunction with the accompanying drawings wherein like reference characters refer to similar parts throughout the several views and in which:

DESCRIPTION OF THE PREFERRED EMBODIMENT OF THE INVENTION

Figures 1, 5, 6:
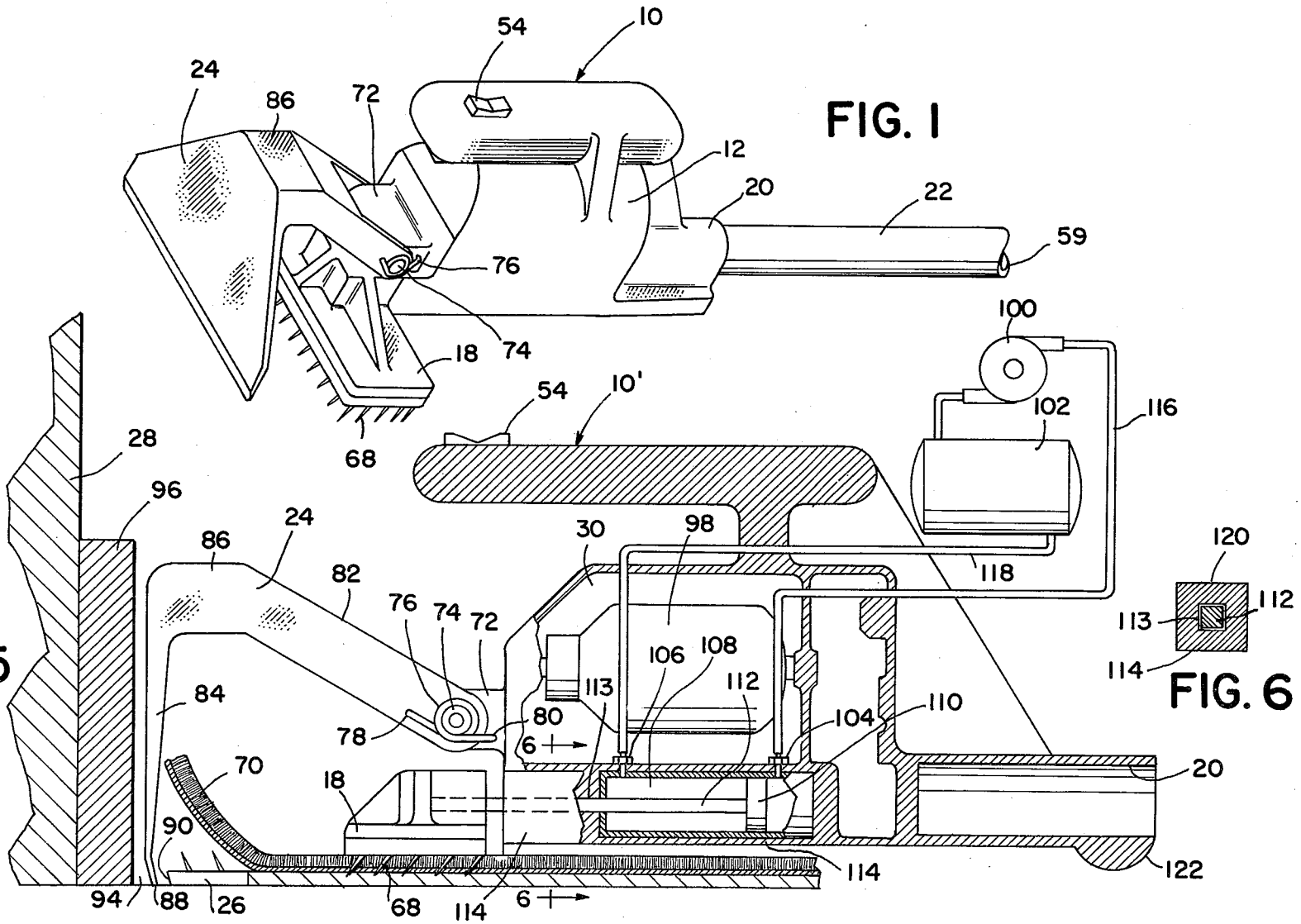
FIG. 1 is an isometric view of a carpet installation tool in accordance with the present invention.
FIG. 5 is a side elevational view similar to FIG. 3, showing another embodiment of the invention.
FIG. 6 is a cross sectional view taken along Line 6—6 of FIG. 5, looking in the direction of the arrows.

Although specific terms are used in the following description for the sake of clarity, these terms are intended to refer only to the particular structure of the invention selected for illustration in the drawings, and are not intended to define or limit the scope of the invention.

Referring now to the drawings, there is shown in FIG. 1 a carpet installation tool generally designated 10 which includes a frame 12, within which is mounted a motor 14. The motor 14 functions elongating means 16 which move a carpet gripper head 18 for carpet stretching purposes. The frame 12 terminates rearwardly in a socket 20 which is sized to receive therein a conventional stretcher tube or pole 22. The frame 12 forwardly carries an anchoring blade 24 of a type suitable for engaging between a tackless strip 26 and the room sidewall 28 or baseboard 96.

Figures 2, 3, 4:
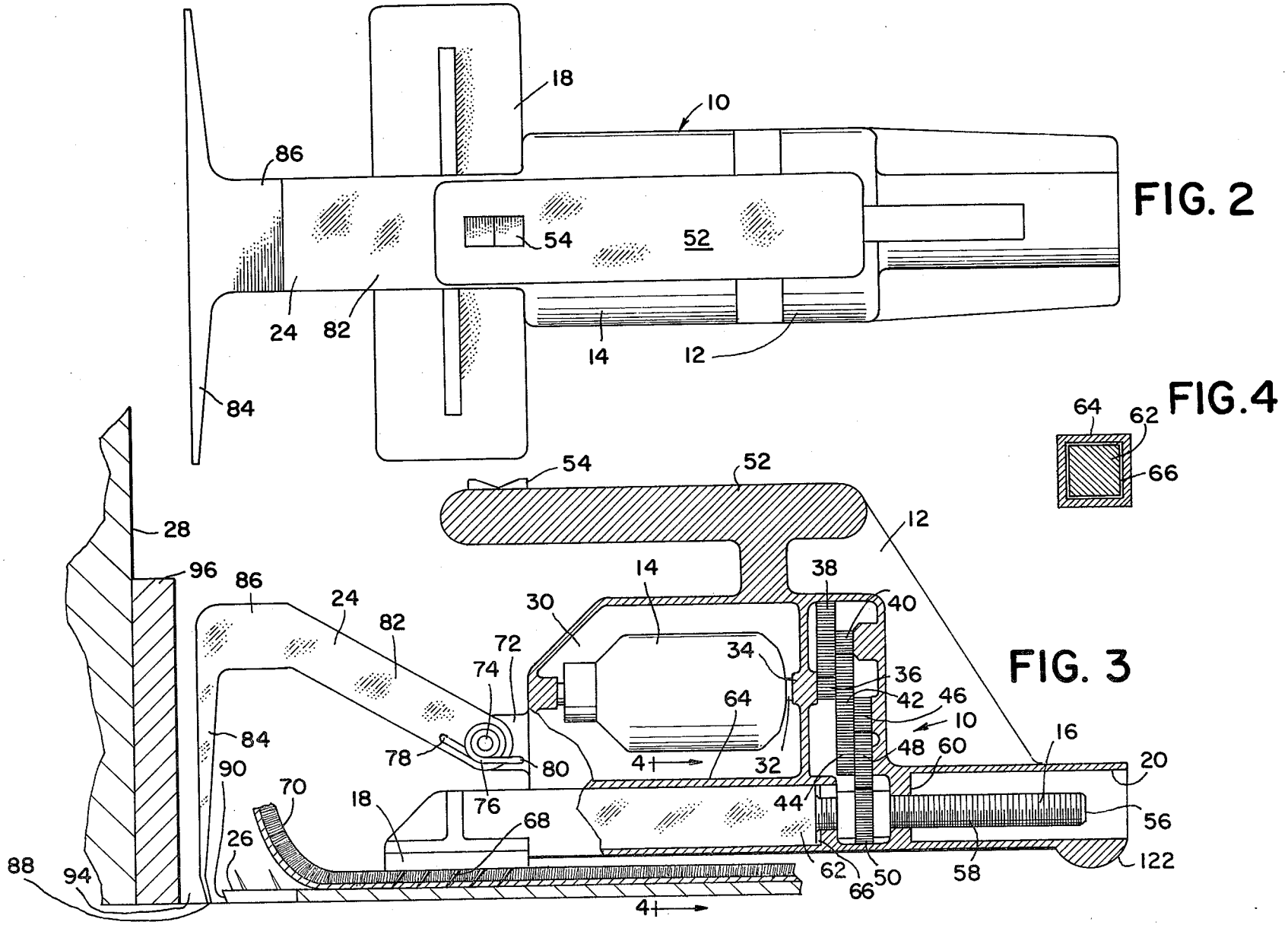
FIG. 2 is an enlarged, top plan view of the tool of FIG. 1.
FIG. 3 is an enlarged, side elevational view of the tool of FIG. 1, partly in section and partly broken away.
FIG. 4 is a cross sectional view taken along Line 4—4 of FIG. 3, looking in the direction of the arrows.

Referring now to FIGS. 2 and 3, the frame 12 includes a central cavity 30 within which the motor 14 is mounted in conventional manner. The motor shaft 32 extends through a frame anchored bearing 34 and rotates a power gear 36 in conventional manner.

The power gear 36 functions the gear train gears 38, 40, 42, 44, 46, 48 to rotate the drive gear 50 in either a clockwise or counterclockwise rotation. The frame 12 upwardly carries a handle 52 which may be integral for carrying and placing the tool 10. An operating switch 54 is preferably located in the handle 52 and functions between a forward position, a stop position and a reverse position. Thus, the gear train comprising the gears 38 – 48, when energized by the power gear 36 will rotate the drive gear 50 in either a clockwise rotation or a counterclockwise rotation depending upon the forward or rearward position of the switch 54.

In the embodiment shown, the drive gear 50 includes external teeth to mesh with the teeth of the gear train gear 48 for rotation as the gear train is rotated. Drive gear 50 is machined or otherwise formed in well known manner to provide an internal thread (not shown) or other construction to engage and function the elongating means 16. The elongating means 16 include an elongated rod 56 which is provided along its length with external threads 58 to engage the interior threads of the drive gear 50 in a manner to cause the elongating means to traverse axially relative to the drive gear 50 as the drive gear 50 is rotated upon function of the motor 14. Thus, the rod 56 of the elongating means 16 can be easily propelled either rearwardly or forwardly depending upon the direction of rotation of the power gear 36. Preferably, the rod 56 projects into the socket 20 and is axially movable therewithin either forwardly or rearwardly as the device is operated. Should an extension pole 22 be utilized as in FIG. 1, it is contemplated that the pole will have a hollow interior 59 of sufficient diameter to overfit the rod 56 and be of suitable size to fit within the socket 20. In use, the pole 22 will be positioned within the socket 20 until the forward portion of the pole abuts the socket shoulder 60 which will therefore serve as a stop.

As best seen in FIGS. 3 and 4, the elongating means 16 terminates forwardly in a ram 62 which is movable relative to the frame 12 upon function of the motor 14. The ram 62 is generally rectangular or square in cross sectional configuration and is movable within a housing 64 which is machined or otherwise treated to provide a square or rectangular bore 66 to receive therein in sliding engagement the square or rectangular ram 62. Because of the angular intersection of the sides of the housing 64 and the ram 62, there can be no rotative movement of the ram 62 relative to the housing 64. Accordingly, the ram 62 can only slide axially within the bore 66 under impetus of the elongating means 16. This inability of the ram 62 to rotate within the housing 64 produces a desired result in that the carpet gripper head 18, which is affixed to the forward end of the ram 62 can therefore also have no rotative tendency relative to the carpet installation tool frame 12. The ram 62 and the carpet gripper head 18 are secured in a permanent manner, such as by welding or by bolting to prevent relative movement therebetween.

The carpet gripper head 18 includes a plurality of carpet gripping pins or nails 68 which are forwardly inclined relative to the carpet gripper head to securely engage the carpet 70 for carpet stretching purposes. As the elongating means 16 is urged forwardly relative to the frame 12 upon function of the motor 14, the ram 62 will move forwardly within the housing 64 to urge the carpet gripper head 18 forwardly. Due to the square or rectangular cross sectional configuration of the ram 62 and the housing bore 66, neither the ram 62 nor the securely affixed carpet gripper head 18 can rotate relative to the frame 12 as the carpet 70 is urged forwardly relative to the carpet installation tool 10 during the carpet stretching operation.

As illustrated in FIGS. 1, 3 and 5, the anchoring blade 24 pivotally affixes to the frame 12 at the front clevis 72. A pivot pin 74, which preferably is constructed to permit easy removal, pivotally interconnects the anchoring blade 24 to the frame 12. The anchoring blade 24 is generally inverted U-shaped in configuration and has its connecting leg 82 pivotally interconnected with the frame clevis 72 by the pivot pin 74. The anchor leg 84 connects to the leg 82 through the upper web 86 and terminates at its lowest extremity in a gripping finger 88. The finger is rearwardly bent to engage the usual slanted forward surface 90 of a carpet tackless strip 26 and to securely anchor thereagainst. Preferably, the angle of inclination of the finger 88 is the same as the angle of inclination of the surface 90 to provide maximum bearing. A torsion spring 76 encircles the pivot pin 74 and terminates in inwardly bent ends 78, 80 which respectively seat within suitable sockets provided therefor in the anchoring blade connecting leg 82 and in the frame 12. The spring 76 is initially tensioned to continuously urge the gripper finger 88 downwardly past a plane defined by the bottom of the frame 12. The spring tension serves to maintain the gripper blade finger 88 behind the slanted face 90 of the tackless strip 26 when the tool is in use.

It is the common practice to utilize carpet stretching tools to stretch one section of a carpet 70 and then to move ten or twelve inches laterally to stretch the immediately adjacent portions of the carpet. The operation is continued in ten or twelve inch increments until the entire carpet has been stretched toward the wall 28 or baseboard 96. In utilizing the tool of the present invention, the bias of the spring 76 serves to retain the finger 88 within the space defined between the side wall 28 or baseboard 96 and the tackless strip surface 90 as the tool 10 is moved laterally in increments during the carpet stretching process.

When it is desired to use the carpet installation tool 10 by employing only a conventional carpet stretching pole 22 as illustrated in FIG. 1, the anchoring blade 24 may be conveniently removed from its association with the tool 10 by drifting the pin 74 outwardly of its recess to thereby free the blade 24 from the clevis 72. The spring 76 will also be removed when the pin 74 is removed. By constructing the pin 74 to be easily removable, the tool 10 can be easily field adjusted for the desired mode of operation. The base 122 is transversely formed in the bottom of the frame 12. The base 122 and gripper head 18 combine to provide a stable tool when in use.

In FIGS. 5 and 6, there is illustrated a modified carpet installation tool 10' which is similar in function and construction to the tool 10 with the exception that the method of applying power to the carpet gripper head 18 includes a hydraulic system (which is schematically illustrated) rather than the gear and threaded elongating means system of the embodiment in FIGS. 1 – 3. The hydraulic system of the embodiment is illustrated schematically in FIG. 5 and includes generally a motor 98, a pump 100 which is functioned by the motor 98 and a fluid reservoir 102. It is contemplated that the motor 98, pump 100 and reservoir 102 will be conventional in design and operation and preferably the hydraulic system 98, 100, 102 can all fit within the frame cavity 30 in a compact manner so as not to interfere with the function of the modified carpet installation tool 10'.

In place of the threaded rod 58 and rectangular cross section ram 62 of the embodiment of FIGS. 1 – 4, a hydraulic cylinder 108 is positioned in longitudinal alignment with the longitudinal axis of the frame and includes a piston 110 and a piston rod 112 extending therefrom in conventional manner. A conduit 116 feeds hydraulic fluid under pressure from the pump 100 to the cylinder inlet fitting 104 on the power side of the piston 110. Similarly, a conduit 118 leads hydraulic fluid (not illustrated) from the outlet fitting 106 on the relief side of the cylinder 108 to the reservoir 102 to form a complete hydraulic circuit.

As best seen in FIG. 6, the piston rod 112 is preferably formed to a square or rectangular cross sectional configuration 113, outside of the cylinder 108 to be a sliding fit within the rectangular or square bore 120 of the housing 114. The forward end of the piston rod 112 connects to the carpet gripper head 18 in a secure manner to prevent relative movement therebetween such as by welding or bolting. The angular bore 120 of the housing 114 and the angular cross sectional configuration of the piston rod 112 act to prevent relative rotative movement between the respective parts to thereby assure only axial relative movement between the gripper head 18 and the tool frame 12. The switch 54 is utilized to energize or de-energize the motor 98 to cause the piston 110 to traverse either forwardly or rearwardly within the cylinder 108 when the tool 10' is in use.

In use, it is contemplated that the gripper finger 88 of the anchoring blade 24 will first be positioned within the space 94 defined between the forward face 90 of the tackless strip 26 and the side wall 28 or baseboard 96 of a room. As above set forth, the spring 76 acts to maintain the finger 88 within the space 94. With the parts thus positioned, the pins 68 of the carpet gripper head 18 are engaged within the carpet 70 and the motor 98 is activated by the switch 54. Pressure on the piston 110 thus generated by function of the hydraulic system pushes the piston rod 112 and the affixed carpet gripper head 18 forwardly toward the blade anchor leg 84 to stretch the carpet 70 by utilizing hydraulic pressure.

Although the invention has been described with a certain degree of particularlity, it is understood that the present disclosure has been made only by way of example and that numerous changes in the details of construction and the combination and arrangement of parts may be resorted to without departing from the scope of the invention.

What is claimed is:

1. In a carpet installation tool of the type including a carpet gripper head, the combination of a frame;

means to move the carpet gripper head relatively to the frame for carpet stretching purposes, said means to move being power actuated, said means to move comprising elongated means responsive to the power actuation to move the the gripper head forwardly or rearwardly relative to the frame, said means to move comprising hydraulic circuit means to urge the carpet gripper head forwardly or rearwardly by using hydraulic pressure, the hydraulic circuit means comprising a pump supplying hydraulic pressure to a cylinder and a piston movable within the cylinder in response to hydraulic pressure, the piston being connected to a piston rod, the said piston rod extending outwardly of the cylinder and being affixed to move the carpet gripper head, said means to move further including means to prevent rotation of the gripper head relative to the frame said means to prevent rotation comprising at least a portion of the piston rod being non-circular in cross sectional configuration.

2. The carpet installation tool according to claim 1 and an anchoring blade pivotally secured to the frame wherein said means to move urges the carpet gripper head towards the anchoring blade.

3. The carpet installation tool of claim 1 and a ram connected to the gripper head to move the gripper head in response to actuation of the means to move.

4. The carpet installation tool of claim 2 wherein the carpet gripper head defines a plane of carpet contact and spring means connected to the anchoring blade to bias the anchoring blade to a position wherein at least a portion of the anchoring blade is urged below the said plane.

5. The carpet installation tool according to claim 4 wherein the spring means is positioned at the pivotal connection between the frame and the anchoring blade.

6. The carpet installation tool according to claim 1 wherein the frame comprises a rearwardly open, elongated socket adapted to receive a wall contacting pole therein.

7. The carpet installation tool according to claim 6 wherein at least a portion of the elongating means extends into the socket.

8. The carpet installation tool according to claim 1 wherein the non-circular portion of the piston rod is reciprocal within a bore provided in the said frame.

9. The carpet installation tool according to claim 8 wherein the cross sectional configuration of the bore conforms to the configuration of the non-circular portion of the piston rod whereby rotative movement of the piston rod within the bore is prevented.

10. The carpet installation tool of claim 1 wherein the non-circular portion of the piston rod is rectangular in cross sectional configuration.

11. The carpet installation tool of claim 10 wherein the rectangular configuration is square.

12. In a carpet installation tool of the type including a carpet gripper head, the combination of a frame, the frame comprising a housing;

means to move the carpet gripper head relatively to the frame for carpet stretching purposes, said means to move being power actuated, said means to move comprising elongating means responsive to the power actuation to move the gripper head forwardly or rearwardly relative to the frame, said means to move comprising an electric motor and a ram extending from the carpet gripper head, said ram having sliding movement relative to the frame, said ram being provided with a threaded section, said means to move comprising a gear train interposed between the motor and the threaded section to move the carpet gripper head relative to the frame upon function of the motor;

the said ram being a sliding fit within the housing;

said means to move further comprising means to prevent rotation of the gripper head relative to the frame;

said means to prevent rotation comprising at least a portion of the ram being non-circular in cross sectional configuration.

13. The carpet installation tool of claim 12 wherein the non-circular portion of the ram is reciprocal within the said housing.

14. The carpet installation tool according to claim 13 wherein the cross sectional configuration of at least a part of the housing conforms to the configuration of the non-circular portion of the ram whereby rotative movement of the ram within the housing is prevented.

15. The carpet installation tool of claim 12 wherein the non-circular portion of the ram is rectangular in cross sectional configuration.

16. The carpet installation tool of claim 15 wherein the rectangular configuration is square.

17. The carpet installation tool of claim 12 wherein the frame comprises a rearwardly open, elongated socket adapted to receive a wall contacting pole therewithin.

* * * * *